US008503912B2

(12) United States Patent
Pohlt

(10) Patent No.: US 8,503,912 B2
(45) Date of Patent: Aug. 6, 2013

(54) DEVICE FOR PREPARING A RECORDING MEDIUM FOR TRANSFER PRINTING TONER IMAGES IN AN ELECTRO-PHORETIC PRINTING SYSTEM

(75) Inventor: Michael Pohlt, München (DE)

(73) Assignee: Océ Printing Systems GmbH, Poing (DE)

( * ) Notice: Subject to any disclaimer, the term of this patent is extended or adjusted under 35 U.S.C. 154(b) by 251 days.

(21) Appl. No.: 12/990,771

(22) PCT Filed: May 5, 2009

(86) PCT No.: PCT/EP2009/055388

§ 371 (c)(1),
(2), (4) Date: Nov. 2, 2010

(87) PCT Pub. No.: WO2009/135826

PCT Pub. Date: Nov. 12, 2009

(65) Prior Publication Data

US 2011/0052274 A1 Mar. 3, 2011

(30) Foreign Application Priority Data

May 6, 2008 (DE) ..... 10 2008 022 212

(51) Int. Cl.
*G03G 15/10* (2006.01)

(52) U.S. Cl.
USPC ..... 399/239; 399/390

(58) Field of Classification Search
USPC ..... 399/131
See application file for complete search history.

(56) References Cited

U.S. PATENT DOCUMENTS

| | | | | |
|---|---|---|---|---|
| 3,609,028 | A | 9/1971 | Egnaczak | |
| 3,642,364 | A * | 2/1972 | Egnaczak | 399/77 |
| 3,717,408 | A | 2/1973 | Radin et al. | |
| 3,856,519 | A * | 12/1974 | Honjo et al. | 430/117.4 |
| 4,139,653 | A * | 2/1979 | Cassiers et al. | 430/97 |
| 4,777,509 | A * | 10/1988 | Komatsubara et al. | 399/381 |
| 6,016,419 | A * | 1/2000 | Hirai | 399/390 |
| 6,743,480 | B1 | 6/2004 | Almog et al. | |
| 7,092,661 | B2 * | 8/2006 | Song | 399/237 |
| 2007/0098469 | A1 * | 5/2007 | Yoshino et al. | 399/340 |
| 2007/0212113 | A1 | 9/2007 | Berg et al. | |

FOREIGN PATENT DOCUMENTS

| | | | |
|---|---|---|---|
| DE | 2055343 | | 5/1971 |
| DE | 4212016 | A1 | 10/1992 |
| DE | 60016045 | T2 | 8/2001 |
| EP | 0756213 | A1 | 1/1997 |
| JP | 2010072388 | A * | 4/2010 |

* cited by examiner

*Primary Examiner* — David Gray
*Assistant Examiner* — Carla Therrien
(74) *Attorney, Agent, or Firm* — Schiff Hardin LLP

(57) ABSTRACT

An electrophoretic printing system is provided comprising a transfer printing station for transfer printing charge images developed with liquid toner comprising a carrier fluid and toner and wherein the developed charge images are transferred to a recording medium. A wetting unit provided adjacent to the recording medium before the transfer printing station as viewed in a movement direction of the recording medium wets the recording medium with a fluid.

12 Claims, 4 Drawing Sheets

DEVICE FOR PREPARING A RECORDING MEDIUM FOR TRANSFER PRINTING TONER IMAGES IN AN ELECTRO-PHORETIC PRINTING SYSTEM

BACKGROUND

For single-color or multicolor printing of a recording medium (for example a single sheet or a belt-shaped recording medium) made of the most varied materials (for example paper or thin plastic or metal films) it is known to generate image-dependent charge images on an intermediate image carrier (for example a photoconductor), which charge images correspond to the images to be printed that are comprised of regions that are to be inked and regions that are not to be inked. The regions of the charge images that are to be inked are made visible via toner with a developer station. The toner image is subsequently transfer-printed onto the recording medium.

Liquid developer containing toner and carrier fluid can thereby be used to ink the charge images. Silicon oil is a possible carrier fluid, for example.

A method for electrophoretic liquid developing in digital printing systems is known from US 2007/212113 A1, for example. A carrier fluid containing silicon oil, with ink particles (toner) dispersed in it, is thereby used as a liquid developer. Further details in this regard can be learned from US 2007/212113 A1, which is incorporated into the disclosure of the present application. FIG. 1 shows the components of a printing system DS with a print group DW as it is known from US 2007/212113 A1, for example. Arranged along an intermediate image carrier 1 (a photoconductor in FIG. 1) are a regeneration exposure 2, a charging station 3, an element 4 for graphical exposure, a developer station 5 to develop the charge images into toner images, a transfer printing station 6 to transfer-print the toner images onto a recording medium 7, and an element 8 to clean the photoconductor drum 1. The transfer printing station 6 has an elastic transfer printing roller 60, a counter-pressure roller 61 and a cleaning unit 62. The developer station 5 rests, a reservoir 53 for the liquid developer, and a cleaning unit 55 cleaning the developer roller. The operation of the developer station is known from US 2007/212113 A1, for example, and reference is made to this.

In this printing system DS the transfer printing of the toner at the recording medium 7 is ensured via a carrier fluid layer between the transfer printing roller 60 and the recording medium 7. The toner crosses the carrier fluid layer from the transfer printing roller 60 to the recording medium 7, driven by electrical forces.

The complete wetting of the surface of the recording medium is required for the effectiveness of the transfer printing process since the toner otherwise cannot reach the surface of the recording medium and remains with the carrier fluid on the transfer printing roller. The toner cannot leave the carrier fluid layer since the electrical forces cannot overcome the surface forces. If a gap thus remains between the carrier fluid layer and the recording medium, the transfer printing at this location is blocked. This case can in particular occur given a fibrous and rough recording medium that has depressions that are markedly deeper than the carrier fluid layer, with the consequence that the depressions are no longer filled with carrier fluid. Furthermore, the take-up capability of the recording medium for the carrier fluid can be different. The recording medium takes up more or less carrier fluid depending on this. Therefore carrier fluid layers of different thickness are required in the transfer printing to the recording medium.

Furthermore, in electrophoretic printing systems with multiple print groups a problem exists with regard to the transfer printing to the recording medium between the first print group and subsequent print groups. In the first print group the recording medium is not wetted with carrier fluid before the transfer printing; in contrast to this, in the following print groups a carrier fluid layer that has already partially penetrated into the recording medium is already present on the recording medium. The take-up capability of the recording medium for additional carrier fluid in the subsequent print groups is thereby altered, with the result that the required carrier fluid supply is different in the subsequent print groups.

In U.S. Pat. No. 3,856,519 a method is described as to how the transfer printing to the recording medium can be improved given liquid developing. Here the problem is that the carrier fluid remains on the recording medium after the transfer printing of the toner images onto the recording medium, and therefore the recording medium is still wet after leaving the printer. The cause is that the carrier fluid has too high a boiling point. In order to avoid this problem, before the transfer printing a fluid that has a low boiling point is applied to the recording medium, with the consequence that this fluid vaporizes quickly after the transfer printing. It is therefore prevented that the carrier fluid arrives at the recording medium in transfer printing.

SUMMARY

It is an object to specify a device to prepare a recording medium for the transfer printing of charge images developed with liquid toner in which the disadvantages depicted above do not occur.

An electrophoretic printing system is provided comprising a transfer printing station for transfer printing charge images developed with liquid toner comprising a carrier fluid and toner and wherein the developed charge images are transferred to a recording medium. A wetting unit provided adjacent to the recording medium before the transfer printing station as viewed in a movement direction of the recording medium wets the recording medium with a fluid.

DESCRIPTION OF THE PREFERRED EMBODIMENT

Figure 1:
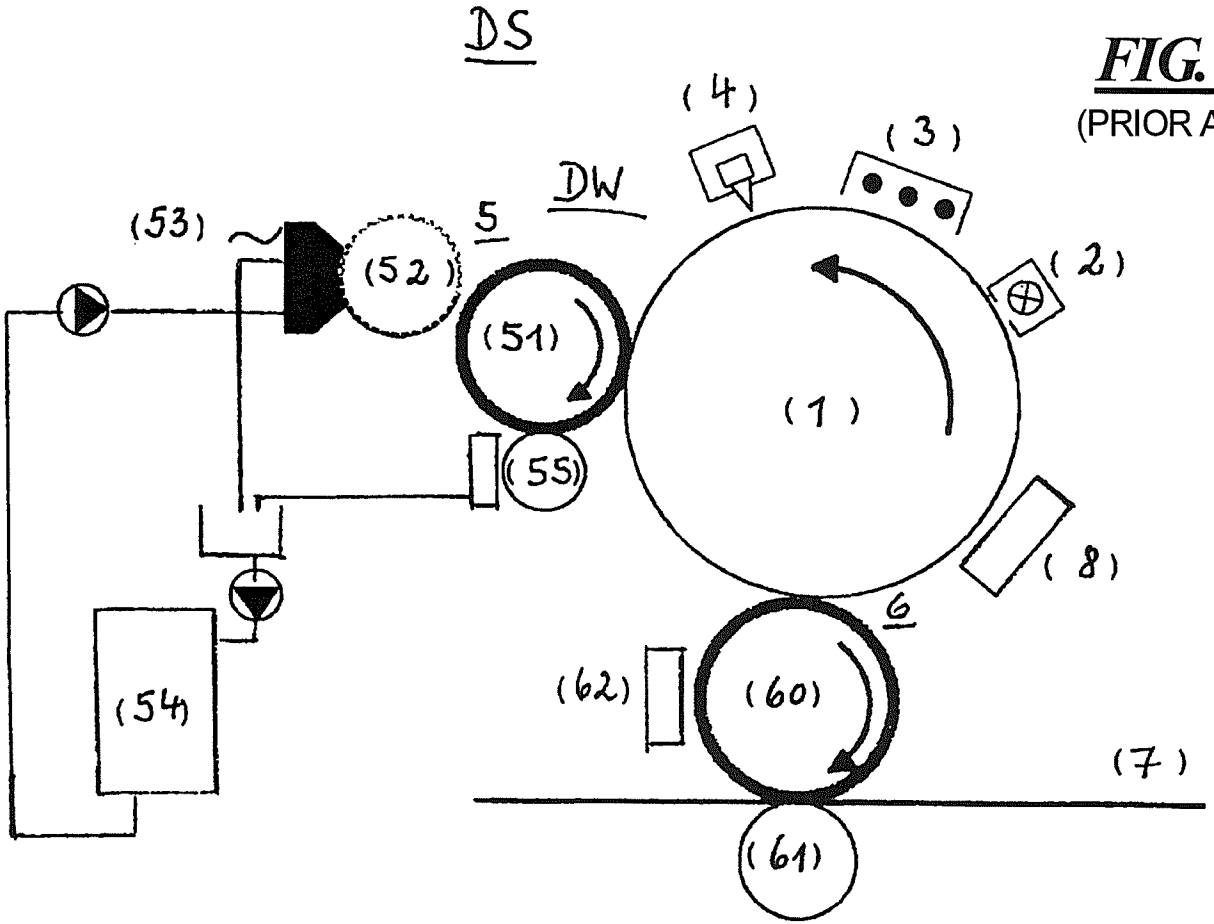
FIG. 1 (PRIOR ART)
FIG. 1 illustrates a prior art electrophoretic printing system showing a print group with a transfer printing station and which employs liquid toner for developing charge images intermediate image carrier which are then transferred in a transfer printing roller to a recording medium.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated system and such further applications of the principles of the invention as illustrated as would normally occur to one skilled in the art to which the invention relates are included.

If a wetting unit that, for example, provides a wetting member resting on the recording medium with which the recording medium can be wetted with fluid is arranged before the transfer printing station (as viewed in the movement direction of the recording medium), the aforementioned problems are dispensed with.

The advantage of the wetting can be further improved if a contact pressure member that presses the recording medium onto the wetting member is arranged on the side of the recording medium opposite said wetting member. Depressions in the recording medium can then also be sufficiently wetted with fluid. A brush or a roller can be selected as a wetting member, just like any other means with which a layer of fluid can be applied to the recording medium. A roller can be used as a contact pressure member.

In order to achieve a uniform application of the fluid on the recording medium it is advantageous if the wetting unit has a distribution member distributing the fluid between the transfer printing station and the wetting member. The distribution member can be a brush or a soft roller.

In order to be able to bring the layer of fluid that is applied to the recording medium to a thickness that is suitable for transfer printing, the wetting unit between the transfer printing station and the wetting member or distribution member can possess a removal member (for example a removal roller) taking up the excess fluid. It is then possible to apply a layer of fluid to the recording medium that is optimal for wetting the recording medium even if this is not suitable for transfer printing, since the fluid is again brought to a thickness that is suitable for the transfer printing before the transfer printing. The removal member can appropriately be arranged between the distribution member and the transfer printing station.

The carrier fluid can appropriately be used as a fluid.

In summary, the following advantages result with the preferred embodiment:

- Independent of the recording medium type, a complete wetting of its surface can be achieved with the aid of the wetting with fluid that takes place upstream from the transfer printing.
- A material and a contact pressure force can be selected more freely for both the wetting roller and the transfer printing roller since the functions of the fluid transfer and the toner transfer are separated.
- The take-up capability of the recording medium for the carrier fluid similarly no longer has any importance.
- A harder material that is then easier to clean can be selected for the transfer printing roller.
- A softer material can be selected for the wetting roller, such that unevenness of the recording medium can be compensated.
- A high contact pressure force can be selected for the wetting roller, such that a deeper contact with the recording medium is created.
- In contrast to this, a lower contact pressure force can be selected for the transfer printing roller so that the print image is not damaged.
- Similar transfer printing behaviors can be produced in multiple print groups that print the same recording medium since the first print group printing the recording medium also prints on a wetted recording medium.
- in particular given the use of multiple print groups, the total consumption of carrier fluid is reduced and therefore a cost savings is achieved since a fluid film is already present on the recording medium before the transfer printing. In color printing less liquid developer can then be used for every color separation.
- In addition to this, the fixing of the toner images is facilitated given use of less carrier fluid since then the carrier fluid vaporizes completely without additional techniques.

Figure 2:
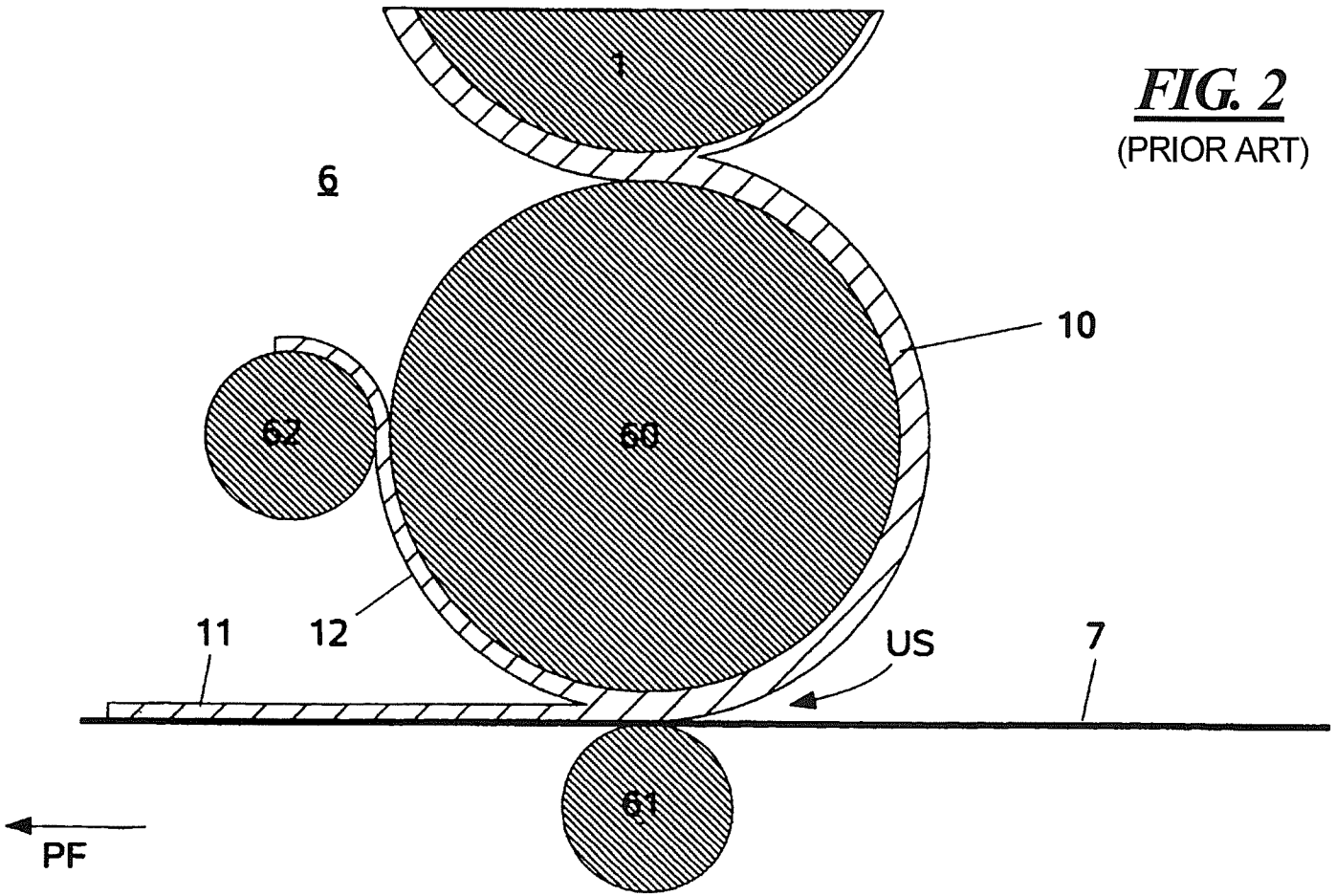
FIG. 2 (PRIOR ART)
FIG. 2 illustrates a section of the print group in which the transfer printing station is shown without application of the preferred embodiment.

For an electrophoretic print group FIG. 2 shows the intermediate image carrier 1 (for example a photoconductor drum) and the transfer printing station 6, here comprised of for example a transfer printing roller 60 that rests on the recording medium 7 and interacts with a counter-roller 61. The recording medium 7 is moved in the arrow direction PF. The course of the carrier fluid 10 with the toner images upon transfer printing is to be learned from FIG. 2. The carrier fluid 10 with the developed toner images is transferred from the intermediate image carrier 1 to the transfer printing roller 60 and is directed from the transfer printing roller 60 past the recording medium 7. A counter-roller 61 that presses the recording medium 7 against the transfer printing roller 60 is arranged on the side of the recording medium 7 opposite the transfer printing roller 60. It is apparent that the carrier fluid 10 at the transfer printing location US is split up into a partial fluid 11 that transfers to the recording medium 7 and a partial fluid 12 that remains on the transfer printing roller 60. In the ideal case the recording medium 7 would be sufficiently wetted by the carrier fluid 10 so that the toner images on the recording medium 7 would be completely transfer-printed. A cleaning roller 62 also rests on the transfer printing roller 60, which cleaning roller cleans carrier fluid 12 remaining after the transfer printing off of the transfer printing roller 60.

Figure 3:
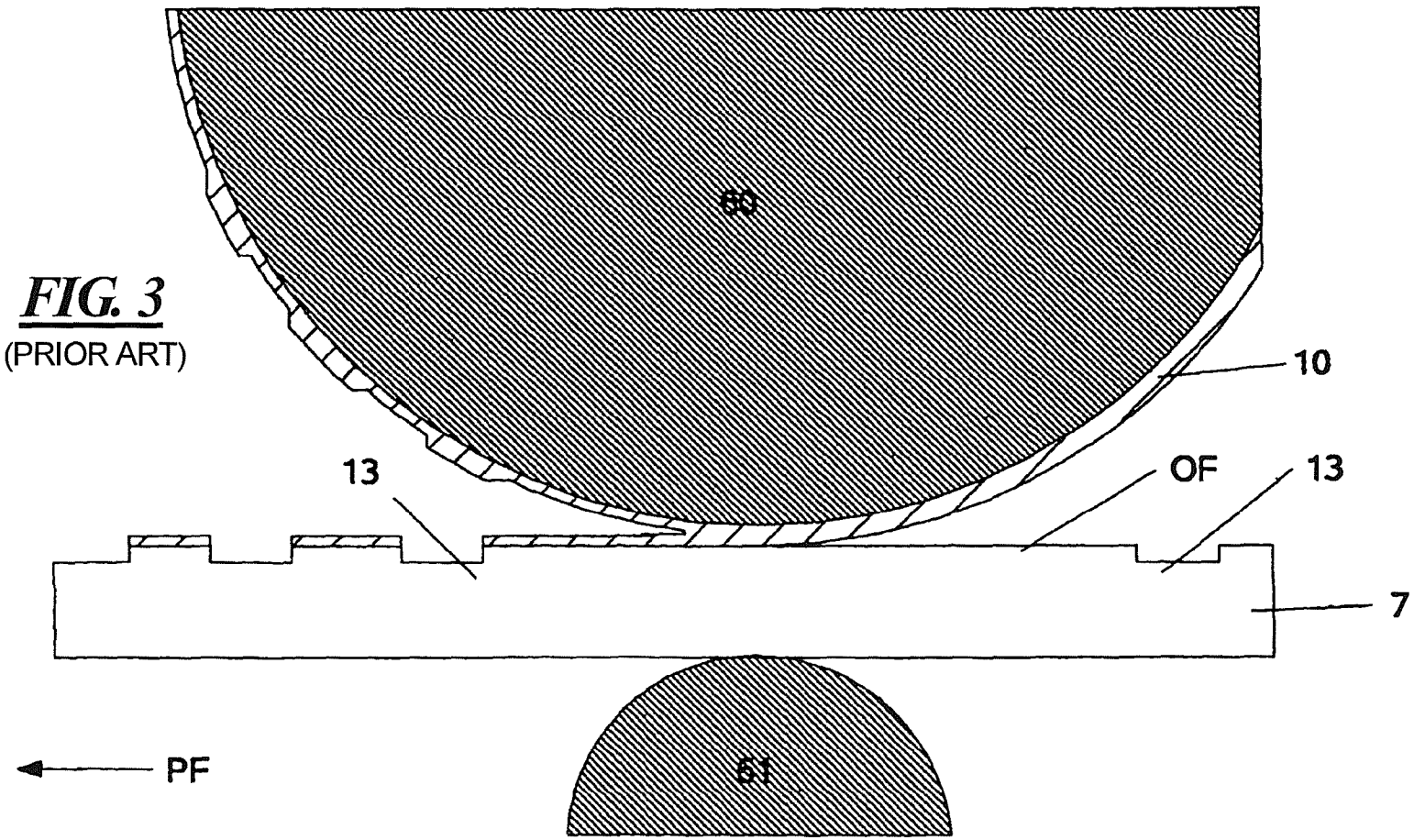
FIG. 3 (PRIOR ART)
FIG. 3 illustrates a section of the print group in which the transfer printing station is shown with a rough recording medium without application of the preferred embodiment.

FIG. 3 differs from FIG. 2 in that the recording medium 7, shown enlarged, has a rough surface OF. In the transfer of carrier fluid 10 to the recording medium 7, gaps 13 in the recording medium 7 are not filled by carrier fluid 13. This can be learned from FIG. 3, in which the gaps 13 have no carrier fluid 10, with the consequence that a transfer printing of toner corresponding to the toner image is incomplete there.

Figure 4:
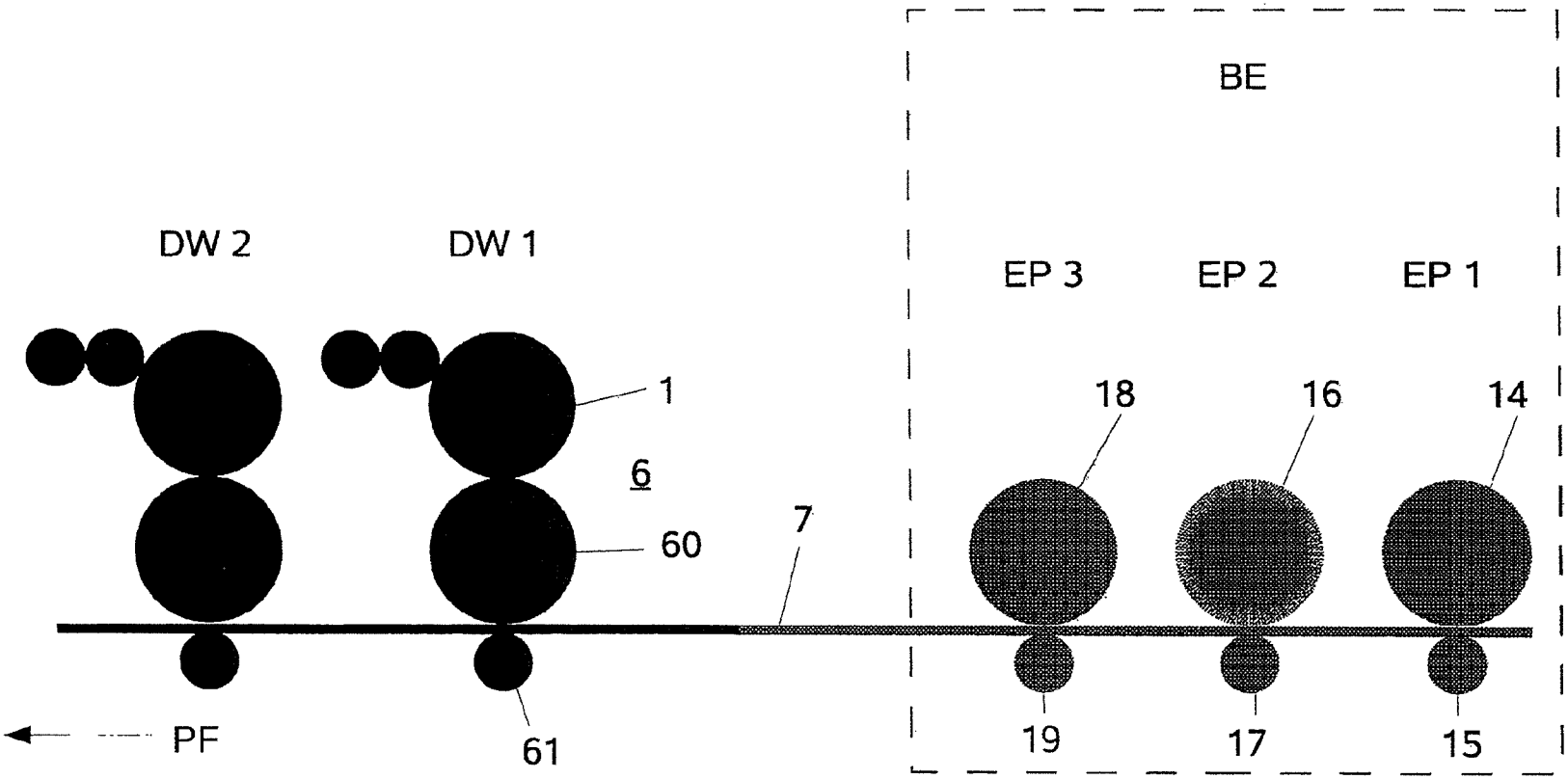
FIG. 4 illustrates an example with multiple print groups with application of the preferred embodiment.

The preferred embodiment is shown in FIG. 4. As an example it is thereby assumed that the printing system DS is comprised of two print groups DW1, DW2. Without the preferred embodiment the first print group DW1 would wet the recording medium 7 with carrier fluid 10 in the first transfer printing. In comparison to the first print group DW1, different behaviors would be present at the second print group DW2 during the transfer printing since there the recording medium 7 is already wetted. In order to achieve an acceptable transfer printing given the transfer printing in one or more print groups DW, according to the preferred embodiment a wetting unit BE is provided before the transfer printing station 6 (as viewed in the movement direction of the recording medium 7). In the wetting unit BE a wetting member 14 is arranged at an installation position EP1, with which wetting member 14 fluid (advantageously carrier fluid) is applied to the recording medium 7. According to FIG. 4 the wetting member 14 is a wetting roller that applies a fluid layer of carrier fluid to the recording medium 7. Since no transfer printing occurs at the point of the wetting member 14, the materials for the wetting member 14 can be selected according to the wetting requirements. For example, additional materials for the wetting member 14 can be used in order to generate a uniform fluid layer on the recording medium 7. In addition to this, the contact pressure can be adjusted via a counter-roller 15 arranged on the opposite side of the wetting member 14, for example in order to be able to wet depressions 13 in the recording medium 7.

In order to design the wetting of the recording medium 7 to be even more uniform, additional structures with which the carrier fluid layer can be influenced can be arranged in the wetting unit BE. For example, a distribution member 16—for example a brush or soft roller—with which the carrier fluid is distributed uniformly across the recording medium 7 and depressions 13 which can also be reached with carrier fluid can be arranged at an installation position EP2 of the wetting unit BE. A counter-roller 17 can be arranged opposite the distribution member 16 to adjust the contact pressure.

For a complete wetting of the recording medium 7 it is appropriate if a thick carrier fluid layer is applied on the recording medium 7 by the wetting member 14. A carrier fluid layer that is too thick can be corrected before the transfer printing station 6 with the aid of a removal member 18 (for example a roller) arranged at the installation position EP3 of the wetting unit BE, which removal member 18 removes the excess carrier fluid from the recording medium 7. The removal member 18 is advantageously provided between wetting member 14 and transfer printing station 6 or—if a distribution member 16 is provided—between the wetting member and the transfer printing station 6. A counter-roller 19 with which the recording medium 7 can be pressed against the removal member 18 can in turn be arranged opposite the removal member 18.

The preferred embodiment is described in connection with a printing system DS with two print groups DW in FIG. 4. However, the preferred embodiment is not limited to this; it can also be used in a printing system DS with one print group or more than two print groups DW.

Given use of the preferred embodiment, a thick carrier fluid layer can thus be applied on the recording medium 7 by the wetting member 14, which carrier fluid layer is uniformly distributed across the recording medium 7 by the distribution member 16 such that depressions 13 in the recording medium 7 are also reached. The excess carrier fluid is then brought again by the removal member 18 to a thickness that is advantageous for the transfer printing of the toner images. In this solution the transfer printing is independent of how much carrier fluid the recording medium 7 absorbs.

Although a preferred exemplary embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should be protected.

I claim as my invention:

1. An electrophoretic printing system, comprising:

a transfer printing station where charge images are developed with liquid toner comprising a carrier fluid and toner and the developed images are then transferred to a recording medium;

a wetting unit before the transfer printing station as viewed in a movement direction of the recording medium and that wets the recording medium with said carrier fluid;

the wetting unit comprises a wetting roller resting on the recording medium, said wetting roller wetting the recording medium with said carrier fluid; and the wetting unit has a distribution roller comprising a brush roller adjacent to the wetting roller in the direction of the transfer printing station, said distribution roller distributing the carrier fluid on the recording medium.

2. The system according to claim 1 in which the wetting unit has a removal member adjacent to the wetting member or adjacent to the distribution member as viewed in the direction of the transfer printing station, said removal member removing excess fluid from the recording medium.

3. The system according to claim 1 in which a contact pressure member presses the recording medium onto the wetting member and which is arranged on a side of the recording medium opposite the wetting member.

4. The system according to claim 3 in which the contact pressure member comprises a counter-roller.

5. The system according to claim 1 in which a contact pressure member presses the recording medium onto the distribution member and which is arranged on a side of the recording medium opposite the distribution member.

6. The system according to claim 5 in which the contact pressure member comprises a counter-roller.

7. The system according to claim 2 in which the removal member comprises a removal roller.

8. The system according to claim 2 in which a contact pressure member presses the recording medium onto the removal member and which is arranged on a side of the recording medium opposite the removal member.

9. The system according to claim 8 in which the contact pressure member comprises a counter-roller.

10. The system according to claim 1 in which a plurality of print groups are provided, each of which has a respective transfer printing station, and wherein the wetting unit is arranged before a first of the print groups as viewed in the movement direction of the recording medium.

11. An electrophoretic printing system, comprising:

a transfer printing station where charge images are developed with liquid toner comprising a carrier fluid and toner and the developed images are then transferred to a recording medium;

a wetting roller before the transfer printing station as viewed in a movement direction of the recording and that wets the recording medium with said carrier fluid;

a distribution roller comprising a brush roller between the transfer printing station and the wetting roller and that distributes the carrier fluid on the recording medium wetting the recording medium; and a removal roller between the transfer printing station and the distribution roller and which removes some of the carrier fluid to set a layer thickness of the fluid.

12. An electrophoretic printing system, comprising:

at least two transfer printing stations where charge images are developed with liquid toner comprising a carrier fluid and toner and the developed images are then transferred to a recording medium;

each of said transfer printing stations comprising a developer roller applying developer to charge images on an intermediate image carrier, and a transfer printer roller between the intermediate image carrier and the recording medium;

a wetting roller before the transfer printing stations as viewed in a movement direction of the recording medium and that wets the recording medium with said carrier fluid, a counter-pressure roller being provided, and the recording medium passing between the wetting roller and the counter-pressure roller;

a distribution roller comprising a brush roller between the transfer printing station and the wetting roller and that distributes the carrier fluid on the recording medium; and a removal roller between the transfer printing station and the distribution roller and which removes some of the carrier fluid to set a layer thickness of the fluid.

* * * * *